US011713426B2

(12) United States Patent
Becker et al.

(10) Patent No.: US 11,713,426 B2
(45) Date of Patent: Aug. 1, 2023

(54) SYSTEMS FOR AUTOMATIC SOLIDS FLOW IN A GASIFIER

(71) Applicant: V-Grid Energy Systems, Inc., Camarillo, CA (US)

(72) Inventors: Richard Becker, Camarillo, CA (US); Wesley Capel, Camarillo, CA (US)

(73) Assignee: V-GRID ENERGY SYSTEMS, INC., Camarillo, CA (US)

( * ) Notice: Subject to any disclaimer, the term of this patent is extended or adjusted under 35 U.S.C. 154(b) by 0 days.

(21) Appl. No.: 17/143,900

(22) Filed: Jan. 7, 2021

(65) Prior Publication Data

US 2021/0207046 A1 Jul. 8, 2021

Related U.S. Application Data

(60) Provisional application No. 62/958,245, filed on Jan. 7, 2020.

(51) Int. Cl.

| | |
|---|---|
| ***C10J 3/40*** | (2006.01) |
| ***C10J 3/34*** | (2006.01) |
| ***C10J 3/26*** | (2006.01) |
| ***C10J 3/72*** | (2006.01) |
| ***C10J 3/82*** | (2006.01) |
| ***C10J 3/42*** | (2006.01) |

(52) U.S. Cl.

CPC . *C10J 3/40* (2013.01); *C10J 3/26* (2013.01); *C10J 3/34* (2013.01); *C10J 3/42* (2013.01); *C10J 3/723* (2013.01); *C10J 3/82* (2013.01); *C10J 2200/09* (2013.01); *C10J 2200/36* (2013.01); *C10J 2300/0916* (2013.01); *C10J 2300/18* (2013.01)

(58) Field of Classification Search

CPC ..... C10J 2300/0916; C10J 3/26; C10J 3/723; C10J 3/32; C10J 3/42; C10J 2200/36; C10J 3/40

See application file for complete search history.

(56) References Cited

U.S. PATENT DOCUMENTS

| | | | | | |
|---|---|---|---|---|---|
| 4,088,455 | A * | 5/1978 | Kohlen | C10J 3/76 | 48/202 |
| 4,583,992 | A * | 4/1986 | Rogers | C10J 3/42 | 48/66 |
| 4,732,092 | A * | 3/1988 | Gould | C10J 3/40 | 60/39.47 |
| 5,279,234 | A * | 1/1994 | Bender | F23G 5/027 | 110/162 |
| 2009/0064578 | A1 * | 3/2009 | Theegala | C10J 3/34 | 48/203 |
| 2009/0119993 | A1 * | 5/2009 | Neves | C10J 3/26 | 48/197 R |
| 2012/0247375 | A1 * | 10/2012 | Bender | F23H 15/00 | 110/259 |
| 2013/0145691 | A1 * | 6/2013 | Surma | F23H 13/08 | 422/198 |

(Continued)

*Primary Examiner* — Imran Akram

(74) *Attorney, Agent, or Firm* — Sheppard Mullin Richter & Hampton LLP

(57) ABSTRACT

A system is described for automatically processing biomass using a series of mechanisms that operate in unison to maintain solids flow through small gasifiers that are otherwise prone to blockage. The system can include an anti jamming mechanism to automatically clear jams within said gasifier using input from at least one sensor.

7 Claims, 20 Drawing Sheets

(56) References Cited

U.S. PATENT DOCUMENTS

| | | | | |
|---|---|---|---|---|
| 2016/0230104 | A1* | 8/2016 | Cheiky | C10J 3/30 |
| 2017/0275543 | A1* | 9/2017 | Senger | C10J 3/42 |
| 2018/0079978 | A1* | 3/2018 | Dressler | C10B 27/00 |
| 2022/0290063 | A1* | 9/2022 | McNamara | F23G 5/46 |

* cited by examiner

Present Invention

SYSTEMS FOR AUTOMATIC SOLIDS FLOW IN A GASIFIER

RELATED APPLICATIONS

This application claims priority to U.S. Provisional Patent Application No. 62/958,245 filed on Jan. 7, 2020, the content of which is incorporated herein by reference in its entirety.

FIELD OF THE DISCLOSURE

The disclosure broadly relates to renewable electricity, and more particularly, to a method and system for managing solids flow in a gasifier, specifically fixed bed gasifiers such as downdraft, updraft or crossdraft gasifiers, by automatic equipment.

BACKGROUND OF THE DISCLOSURE

Gasification can convert carbon-containing materials to useful chemical products. These chemical products typically involve synthesis gas (syngas), which can be combusted to produce electricity, or chemically reacted to produce oxygenates or hydrocarbons in catalytic systems. The most common form of gasification in large scale industry is coal gasification, which is practiced on a worldwide basis, most notably by electricity producing power plants. Coal is delivered via gravity methods or via a slurry, and solids flow is not an issue at large scales. On the other hand, gasification using biomass is desirable from the point of view of decreasing greenhouse emissions, as biomass use is essentially a carbon neutral process. Biomass use also reduces a country's dependence on fossil fuels. Due to its portability and widespread availability, biomass is used extensively in small scale gasification systems. As an example, biomass gasification was practiced extensively during World War II in automobiles and trucks. The most common method for managing the flow of biomass through gasification systems utilizes gravity drop equipment. Major challenges with biomass flow in gasifiers include removing bridging within the gasifier, along with the need to manually shake and jiggle the biomass within the gasifier to remove jams. The clearing often necessitates stopping the gasifier, incurring a double cost of lost production and labor costs for the personnel tasked with the clearing.

Prior art methods for managing solids flow in gasifier include a rotatable grate feature in U.S. Pat. No. 5,192,514 issued to Sasol, Inc. applicable to a fixed bed coal gasifier. In this gasifier configuration, coal flow is controlled via a coal lock. A rotatable grate mechanism at the bottom of the gasifier is rotatable about the vertical axis of the ash discharge outlet and includes at least one upwardly projecting finger or disturbing formation to disturb the ash bed formed in use above and around the rotatable grate, when the rotatable grate is rotated.

U.S. Pat. No. 5,230,716 issued to US Department of Energy discloses a rotating conical grate assembly which crushes agglomerates of clinkers at the bottom of a fixed bed gasifier by pinching them between stationary bars and angled bars on the surface of the rotating conical assembly. U.S. Pat. No. 4,764,184 teaches a rotating grate with scraping blades. U.S. Pat. No. 4,652,342 teaches a motor driven anti-bridging mechanical agitator having a crankshaft. The agitator is comprised of pushrods having scoop arms, the pushrods are driven in a reciprocating manner upwards and downwards via the crankshaft. U.S. Pat. No. 4,134,738 discloses a poking system comprising a retractable pokerod assembly used to agitate a coal bed and having means for temperature sensing clinker formation, and position sensing relative to the housing which are used to determine the frequency and extent of the actuation of the pokerod assembly. U.S. Pat. No. 4,853,992 discloses a biomass gasifier which uses a rotatable grate in conjunction with stationary bars above the grate to shear large charcoal particles so that they may be channeled through the grate.

Bridging can be a more significant issue in biomass gasifiers than in those operating with coal. Biomass undergoes significant changes in particle size and density as it traverses a gasifier, transforming to materials possessing different physical properties and different flow characteristics in the distinct drying, pyrolysis, combustion, and gasification zones. Excessive tar buildup can also lead to a coating on the biomass which acts as an effective bridge between biomass particles. When this coating precipitously reaches the combustion zone, a rapid highly exothermic event can occur which destroys the zone architecture. In gasifiers that are run in conjunction with an engine, bridging can have deleterious effects on engine operation if synthesis gas is not supplied at a constant rate.

SUMMARY OF THE DISCLOSURE

Embodiments of the present disclosure are directed toward methods for preventing biomass and charcoal bridging by automating solid flow of feed material and gasification products in a fixed bed gasifier. These methods are applicable to a wide range of biomass materials and wide range of moisture levels. Constant feed rate through the gasifier is desired without logjams or congestion points. Processes are provided for clearing logjams and congestion as input biomass is converted to char or ash in vertical column gasifiers. Some methods use aliquot metering of biomass regulated by feedback from sensors that monitor the extent of combustion of biomass in the gasifier. Other methods use processes to disturb solids in a radial direction without significantly disturbing the solids in the vertical direction. These methods destroy bridging without mixing combustible material with hot char. Other methods rely on shocks to shake material to assure continued movement. In some embodiments, this shock method is linked to a grate rotation to dislodge bridge particles. Still other methods use size selectivity of material as the material is reduced in size through the various stages of the gasifier, resulting in a uniform or semi-uniform product flow. Additional agitation methods also include methods for vibrationally exciting the gasifier walls and the material within.

A specific implementation of these various methods is disclosed. Aliquot distribution is implemented via intake augers that receive feedback from optical sensors and outtake augers that remove material once it is fully processed. The radial mixing without vertical displacement method is implemented via a shaft that is attached an auger having a large void volume and which is inserted into the reduction regime to radially mix the material in this region. Size selectivity is implemented via an adjustable grate assembly that varies its opening depending on particle size and interactively responds to solids flow through the gasifier. This is useful particularly for passing through certain types of particles, such as biochar particles. The implementation of shock-induced displacement method relies on a rotatable grate assembly that is actuated by hammer-like impacts that impinge on the grate assembly. Vibration excitation of gasifier walls is achieved via a vibrating motor attached to the gasifier walls. In some embodiments, the gasifier is selected from downdraft, updraft or co-current gasifiers.

The full nature of the advantages of the disclosure will become more evident from the following detailed description.

BRIEF DESCRIPTION OF THE DRAWINGS

Certain embodiments of the present disclosure will hereinafter be described in detail, by way of example only, with reference to the accompanying drawings, in which:

FIG. 6*a* shows the mixing device in a resting position, while FIG. 6*b* shows the device in a fully extended position. FIG. 6*c* (prior art) depicts a conventional agitation device, while

DETAILED DESCRIPTION

In the following paragraphs, embodiments of the present disclosure will be described in detail by way of example with reference to the attached drawings. Throughout this description, the preferred embodiment and examples shown should be considered as exemplars, rather than as limitations on the present disclosure. As used herein, the "present disclosure" refers to any one of the embodiments of the disclosure described herein, and any equivalents. Furthermore, reference to various feature(s) of the "present disclosure" throughout this document does not mean that all claimed embodiments or methods must include the referenced feature(s).

Figure 1:
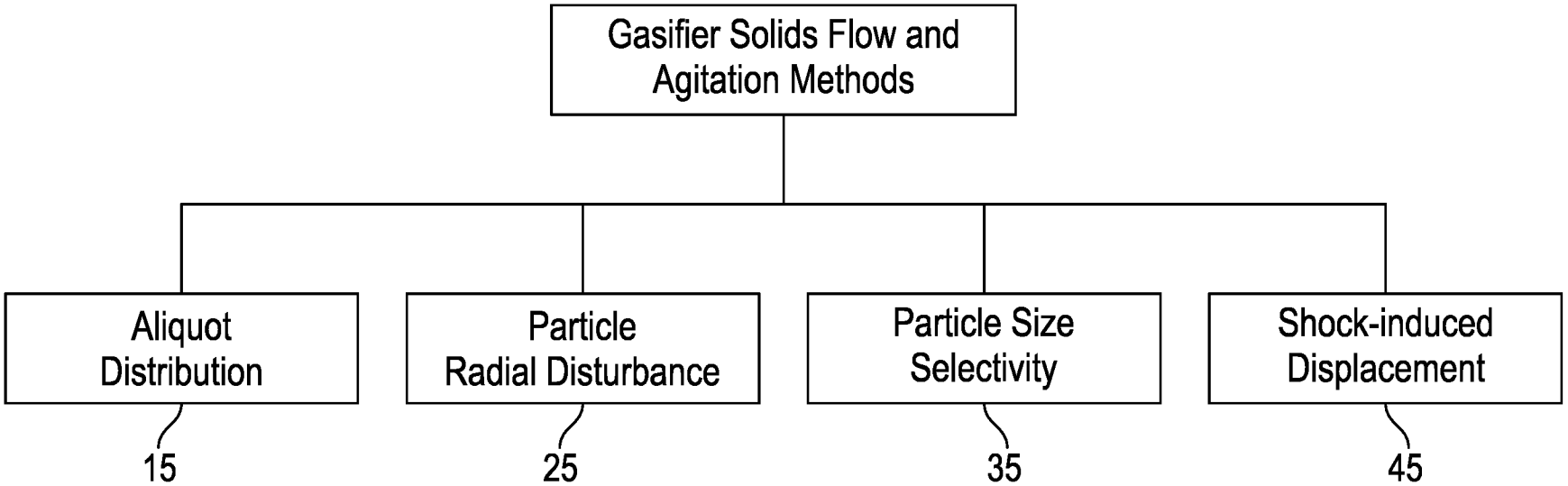
FIG. 1 is a diagram illustrating the various methods for preventing biomass and charcoal bridging, as set forth herein.

Embodiments of the disclosure utilize various processes and agitation methods for facilitating the flow of solids through a gasifier. FIG. 1 provides a list of solid flow processes and agitation methods incorporated in the present disclosure which, separately or in combination, constitute a novel method for processing solids through a gasifier. This disclosure is applicable to any vertical gasifier relying on gravity for its operation, including counter-current, current, or co-current fixed bed gasifiers, also termed downdraft, updraft and entrained flow gasifiers. The agitation and transport methods provided in FIG. 1 effect solids through a gasifier as material is transformed from raw form to ultimately, a carbonaceous product, ash and product gas, also referred as synthesis gas.

The raw form input is a biomass input, a term for the biodegradable fraction of agricultural products, residual or not, forestry products, industrial or municipal solid waste. Biomass generally refers to material originating from plant matter, in particular material containing cellulose, hemicellulose, lignins, lignocellulosic polymers, and extractives as composition. Forest products refers may refer to forest residue, wood pellets, wood shavings, bark, peat, waste wood, energy crops, virgin wood, recycled wood, sludge, sawdust, wood chips, as well as as black liquor and other products derived from pulp and paper operations. Biomass may also refer to herbaceous material such as miscanthus, rice husk, straw, and and sorghum as well as waste edible materials such as seeds and grains. Biomass may also refer to animal derived products such as manure. The term may also be used for a mixture of one or more of the above.

As the input material flows through a gasifier, it experiences several processes, including drying, pyrolysis, partial combustion and, finally, char gasification. At each of these stages, material properties change, either as density changes or chemical transformations, and there is a consequent need to process material of differing properties. Conventional methods primarily use gravity to direct material flow with no direct intervention or intervention methods that are quite different from those described herein. The active approach of the present disclosure as shown in FIG. 1 comprises at least one of: (i) method 15 which comprises an aliquot or batch method for processing solids flow through the gasifier; (ii) method 25 that utilizes material radial mixing without vertical displacement; (iii) method 35 that utilizes size particle selectivity for processing solids flow; and (iv) method 45 which uses a shock technique onto a grate assembly to effect material agitation.

Figure 2:
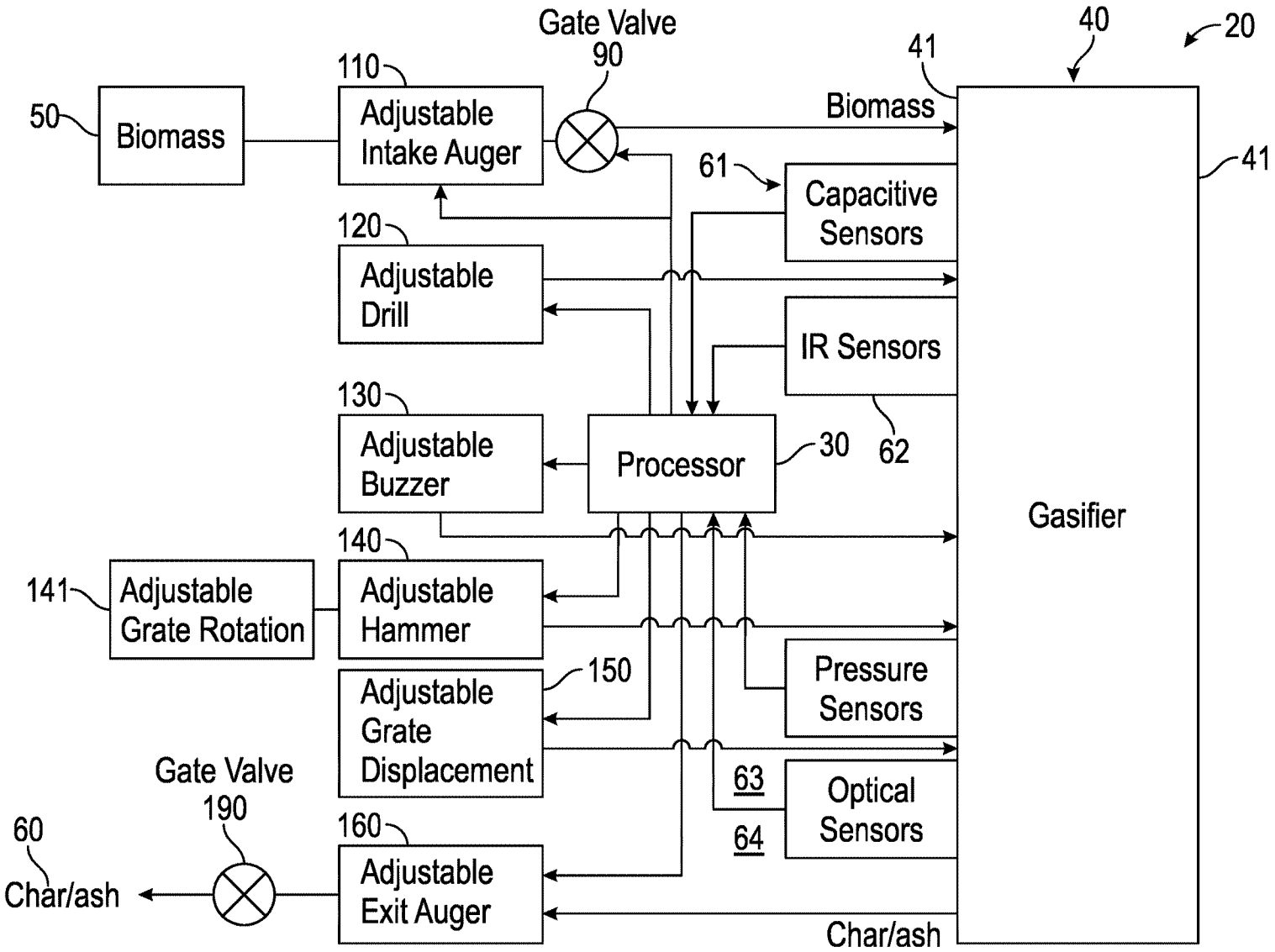
FIG. 2 is a diagram illustrating a system configured to implement the various methods for preventing biomass and charcoal bridging, as set forth herein.

An implementation of these methods in a gasifier system is shown in FIG. 2. Specifically, gasifier system 20 processes biomass 50 at one end of gasifier 40 and ouputs char/ash 60 at the other end. Gasifer 40 has upright cylindrical walls 41 defining a biomass gasification chamber within, and has sensors 61, 62, 63 and 64 attached to or within the walls that provide feedback on solids flow through the gasifier. Feedback information is fed to a processor 30 that controls the inflow system 110, outflow system 160, and agitation devices 110, 120, 130, 140 and size selection device 150.

Figure 3:
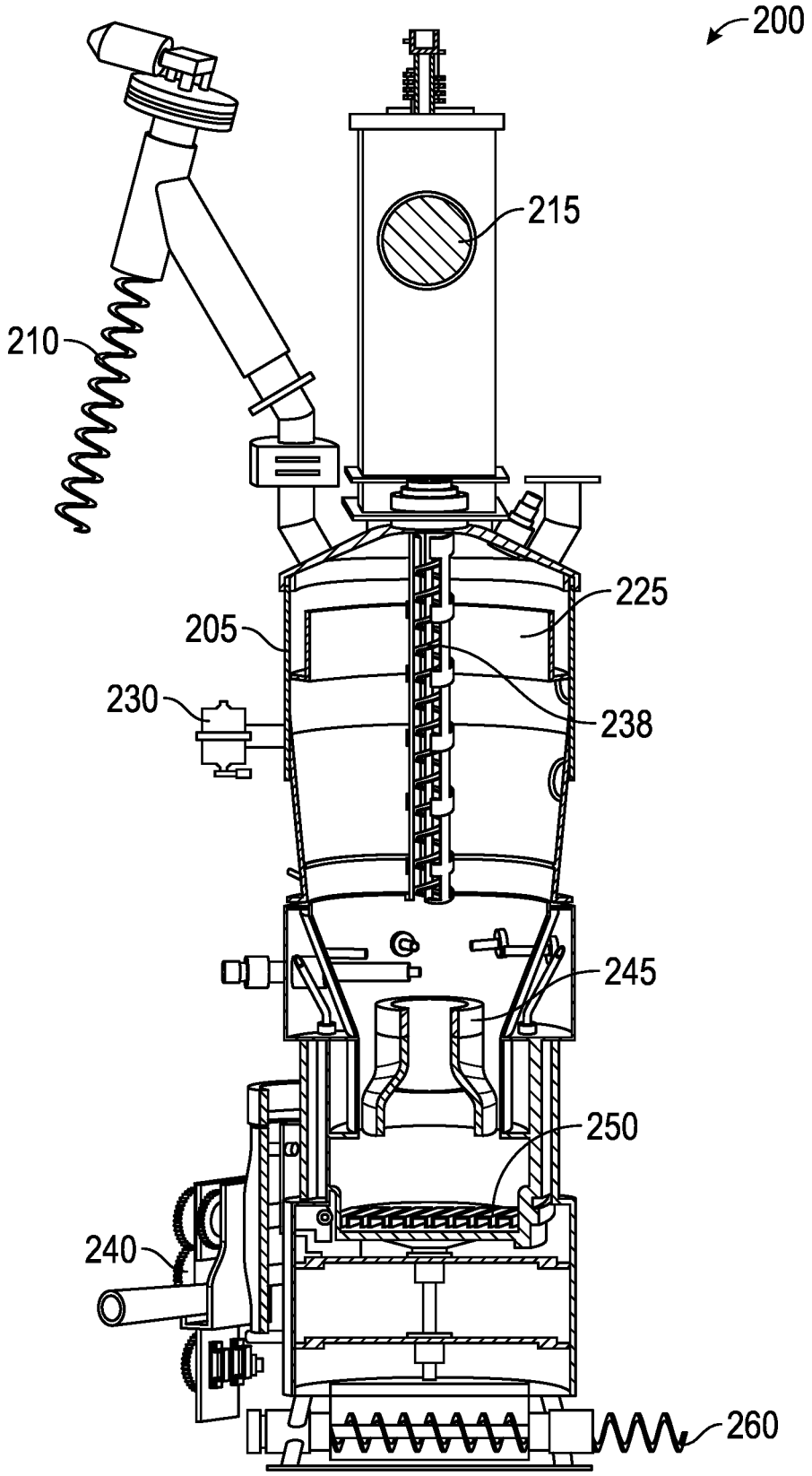
FIG. 3 is a cross-sectional view illustrating a physical arrangement of gasifier elements in FIG. 2.

FIG. 3 is a cross-sectional view illustrating a physical arrangement of gasifier elements in FIG. 2. Specifially, FIG. 3 shows a three dimensional drawing of intake/outtake devices 210 and 260, and agitation devices 230, 238, 240, and 250 incorporated in a downdraft gasifier system 200. System 200 has an intake auger 210 with gate valve that removes biomass from a reservoir (not shown). This biomass feeds into gasification chamber 225 that fills up to a preset level monitored by optical sensor or infrared sensors located within the chamber.

As the gasification process proceeds several zones of drying, pyrolysis, partial combustion and gasification are established. Agitation device 238 implementing method 25 is actuated by assembly 215 and is used to radially mix the gasification zone without disturbing the biomass, pyrolysis, or combustion zones. Agitation device 238 comprises a retractable shaft welded to an auger with large void volume. As material is gasified, it builds up a layer of char and ash. Depending on extent of gasification, material passes through displaceable grate assembly 250, which is an implementation of method 35. An agitation device 240 implementing method 45 is attached to grate assembly 250 and enables the transmission of hammer like impacts upon gasifier walls. This agitation device is linked to grate assembly 250 and enables grate rotation. Material exits through outflow assembly 260 which incorporates one or two gate valves and also implements aliquot method 15. The components of this implementation by reference of the particular method represented will now be described.

Aliquot distribution method 15 comprises dispensing and removing metered amounts of material from the gasifier. Input biomass is dispensed into the gasifier using feedback from sensors indicating fill level in the gasifier. Material is removed from a reservoir container system and deposited into the gasifier by various techniques, such as auger or belt transport, based on sensor input identifying a need for more material. The reservoir system stores a volume of material that is significantly more than the amount of material in the gasifier at any one time. The advantage of this method is that it decouples the solids flow inside the gasifier from the input or output flow. An implementation of this method is shown in FIG. 4 and FIG. 5.

Figure 4:
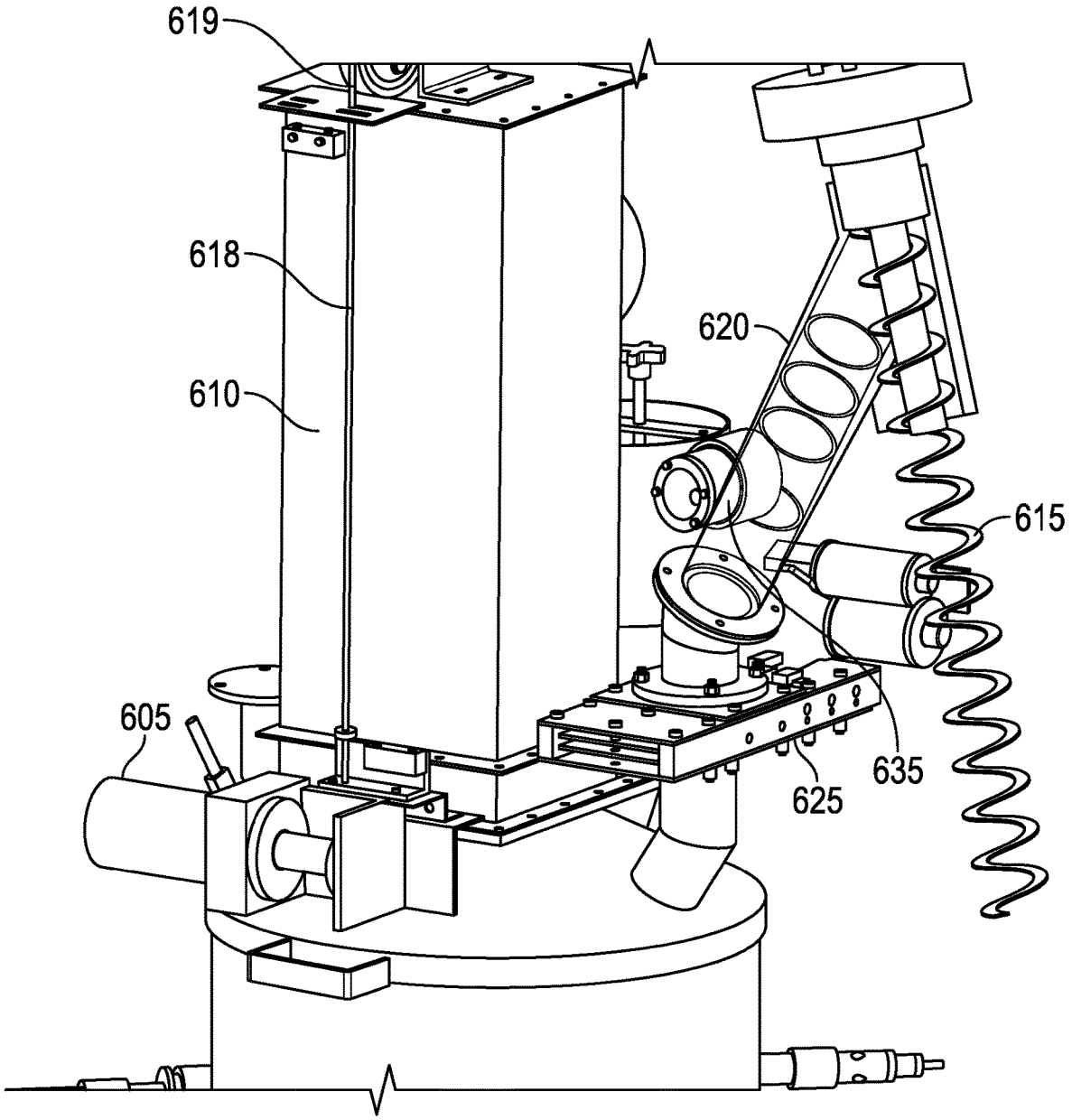
FIG. 4 is a perspective view showing an adjustable intake auger and valve component which directs biomass in flow to the gasifier, and is a component of the metered deposition method of the disclosure.
Figure 5:
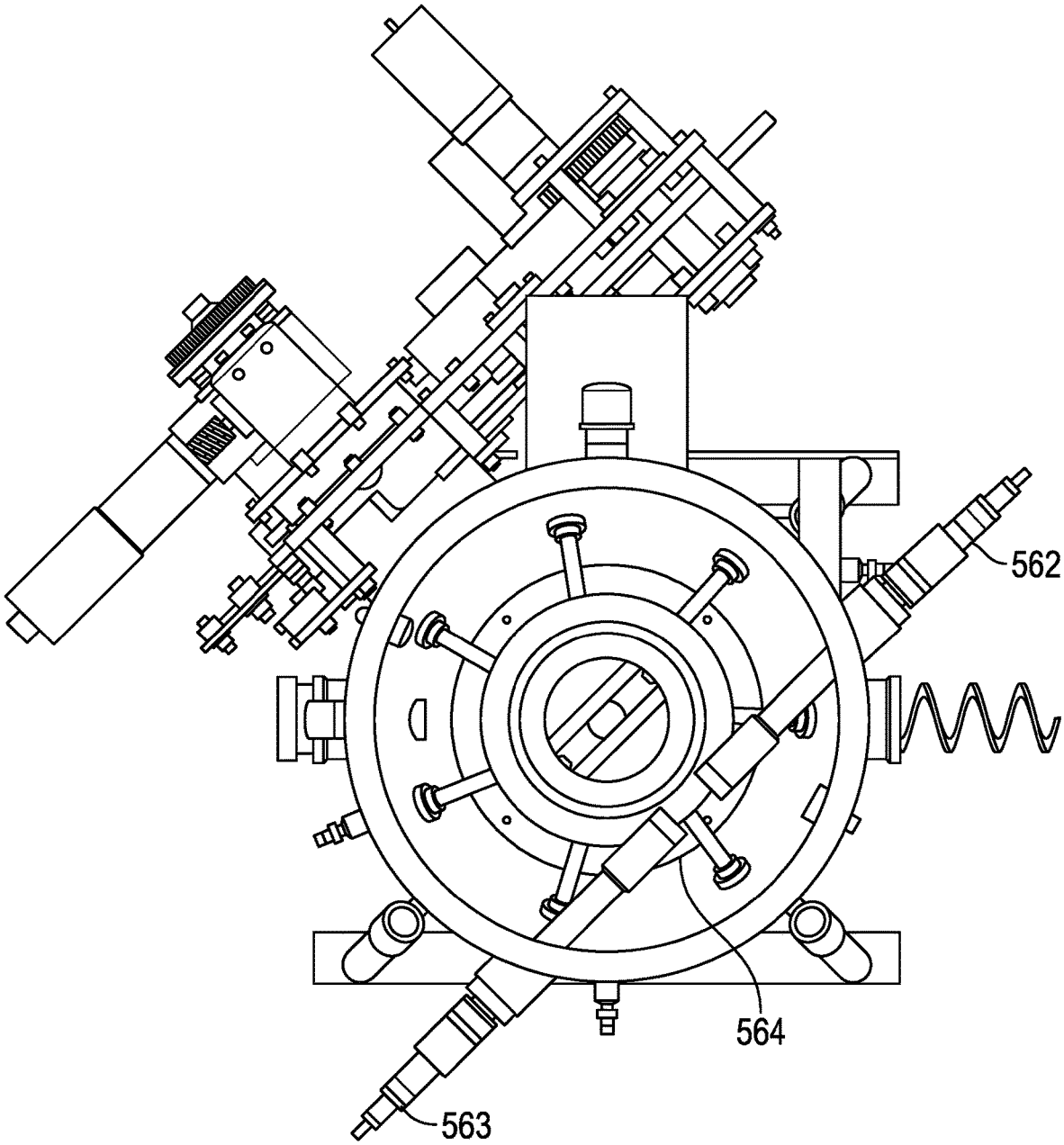
FIG. 5 is a top view illustrating the sensor assembly used in the metering deposition method.

Referring to FIG. 4, input biomass is conveyed through auger 615 to tubular container 620 which is intercepted by gate valve 625. This valve is a loadlock that opens to admit material in, but otherwise remains closed to exclude oxygen from the top of the gasifier. Optionally, a capacitive sensor 635 is provided to detect the presence or absence of biomass in tubular container 620. The biomass fill level in the gasifier chamber is monitored by optical or infrared sensors 562, 563 (FIG. 5) which detect the presence of biomass indirectly (even in the presence of smoke) whenever sensor tip 564 is blocked. There may be a plurality of these sensors in the gasifier to gauge the fill level at several points.

Figure 6A:
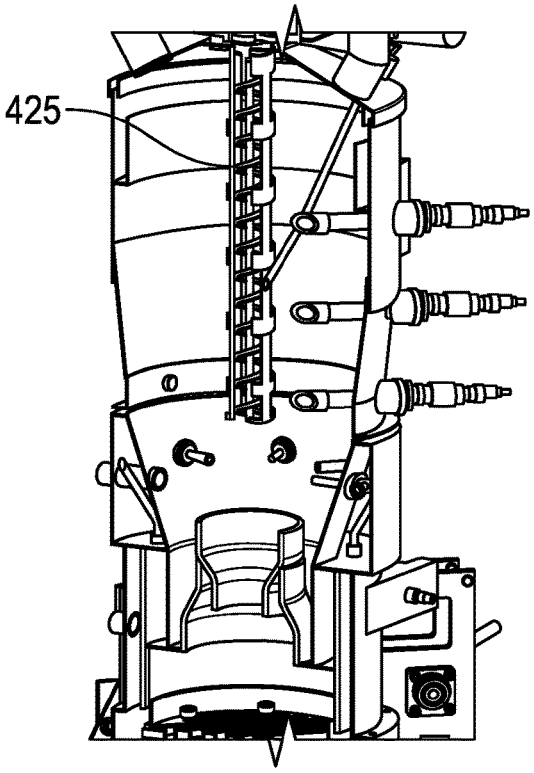
FIG. 6*a* and FIG. 6*b* are cross-sectional views showing implementation of a mixing device which performs radial displacement with little vertical displacement, the mixing device comprising a retractable shaft welded to a thin auger.
Figure 6B:
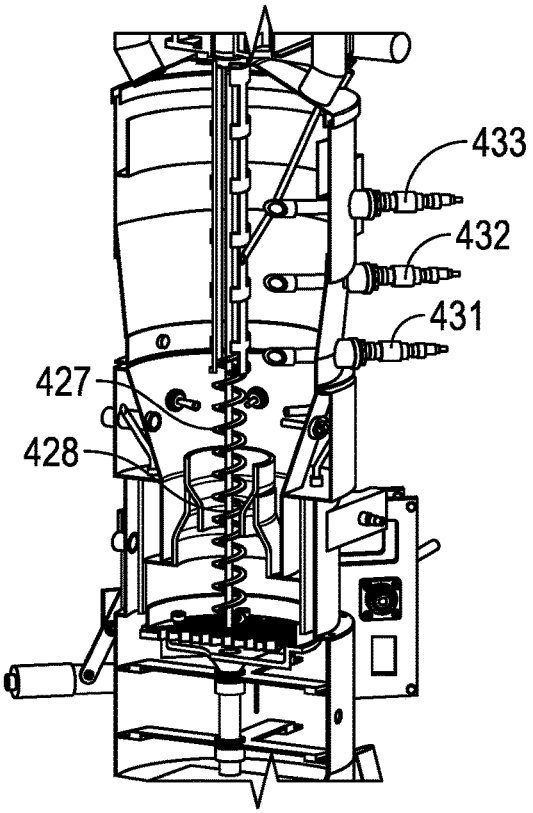
Figure 6C:
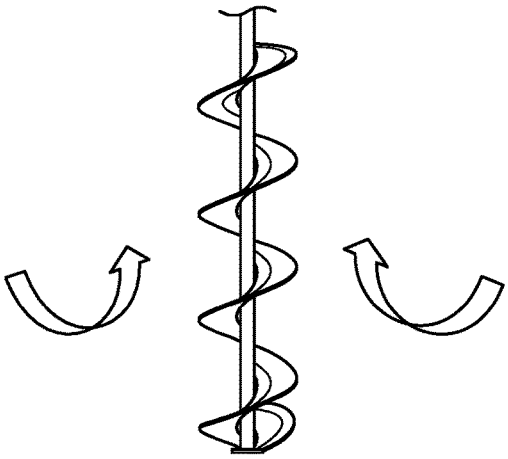
FIG. 6C (Prior Art)
Figure 6D:
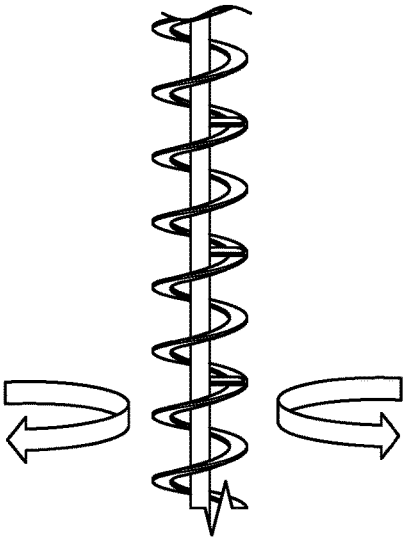
FIG. 6*d* depicts an agitation device including a guide tube, solid shaft, and flattened wire which spirals around a solid shaft.

FIG. 6*b* shows an embodiment with 3 sensors, in which the lowest placed sensor 431 is activated under normal loads. When the biomass fill level is below this level, the auger is activated to input biomass until sensor 432 is activated, at which point the auger stops until sensor 431 is again activated. Sensor 433 can be used as a sensor that acts as an additional alarm. In this manner a consistent load is maintained. An additional advantage provided by this method is that multiple feeds are allowed at the same time. Thus different biomass feedstocks can be fed to the gasifier without affecting performance, due to the decoupling of the feed system to the gasification flow through.

The radial mixing without vertical displacement method 25 exerts minimal disturbance of the drying, pyrolysis, and combustion zones, while effecting radial mixing in the reduction zone. This is important for preventing premature mixing of the zones, as such a mixture can result in an explosive event. In a typical auger drilling operation, the rotation of the blade causes material to be removed out of the hole being drilled. In a gasifier with multiple zones, this simple drilling, while destroying bridging, would result upon retraction of the auger in a conduit which would allow hot gases to escape to the feed zone, leading to premature combustion. By contrast, the disclosed method destroys bridging without destroying gasifier performance. The method is implemented by agitation device 238 which comprises guide tube 425, solid shaft 428, and flattened wire 427 which spirals around solid shaft 428. Shaft 428 is attached or welded to wire 427 only at select shaft protrusions, leaving significant void space between the shaft and the wire. This void space enables the assembly to be retracted without removing material or intermixing material between each zone. The void space also allows material to be radially mixed whenever the shaft rotates, thereby breaking the tar interface causing crusting. The two extremes of position for the retractable assembly are shown in FIGS. 6*a* and 6*b*. Shaft 428 is driven by motor 605 via linkage 618 (FIG. 4). Sealed housing 610 sits on top of the gasifier and is tall enough to provide room for the required vertical range of motion of agitation device 238.

Figure 7:
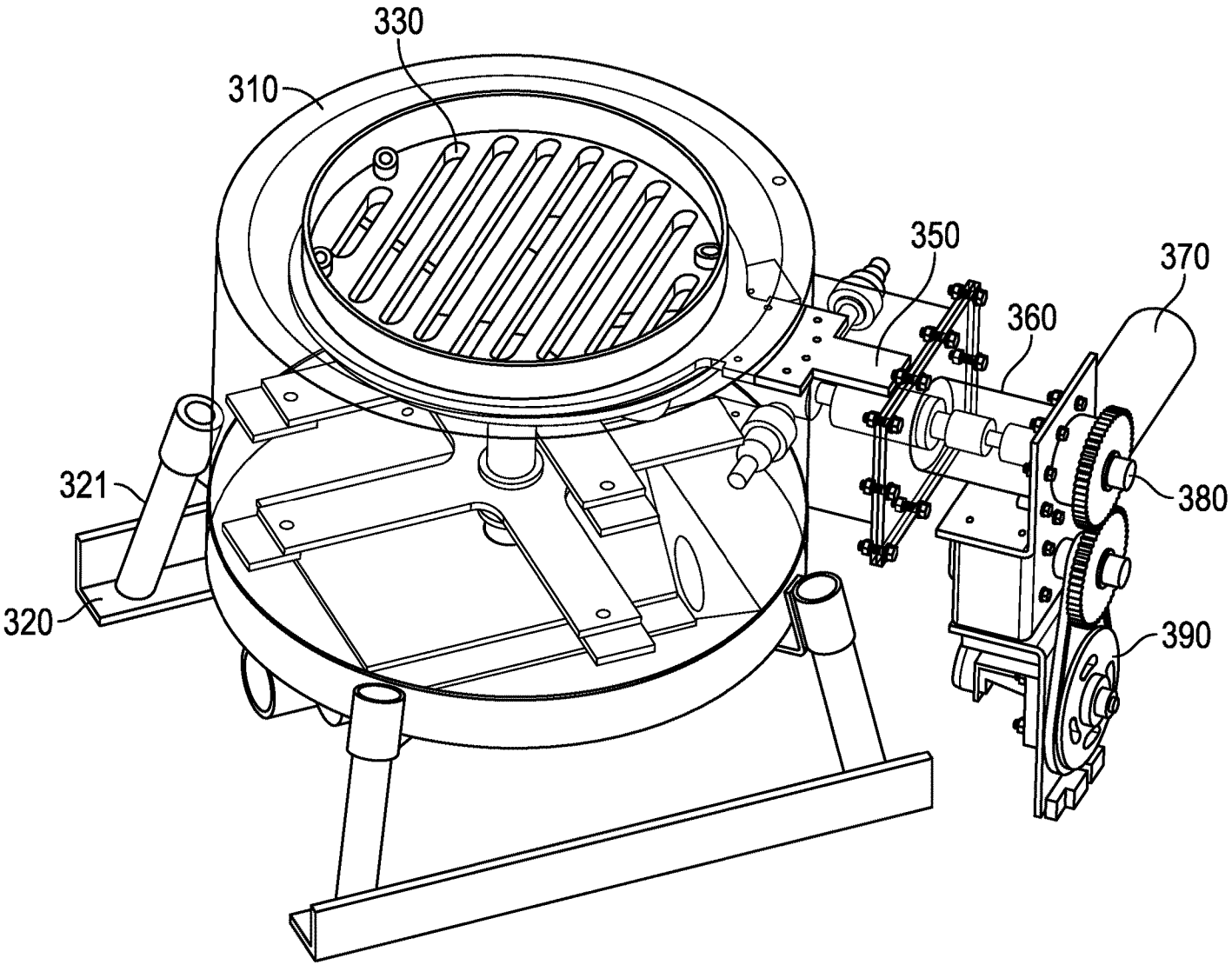
FIG. 7 is a perspective view depicting a grate assembly which is an implementation of a particle size selectivity method and a shock-induced displacement method of material within a gasifier.

The solids flow method 35 uses particle size discrimination in processing material through the gasifier. This method selectively passes particles of a size or structure, such as ash or char particles, through an adjustable grate assembly and deters large size particles from passing through. The particle discrimination can be effected via different ways, such as a variable sieve assembly, a variable grate assembly, or other means able to control orifice dimensions for material exiting the gasifier. This particle discrimination allows control of material residence in the reduction zone, and can be used to control the ratio of carbonaceous material to syngas production. An implementation of this method is embodied in the variable grate assembly shown in FIG. 7. A grate 330 with horizontal slots is housed near the bottom of gasifier standing on base 320 with legs 321. Grate 330 sits on top of a similarly constructed grate (not shown) and is displaced relative to the bottom grate by servo mechanical means comprising motor 370, gears 380 and 390, and plunger 360.

Figure 8B:
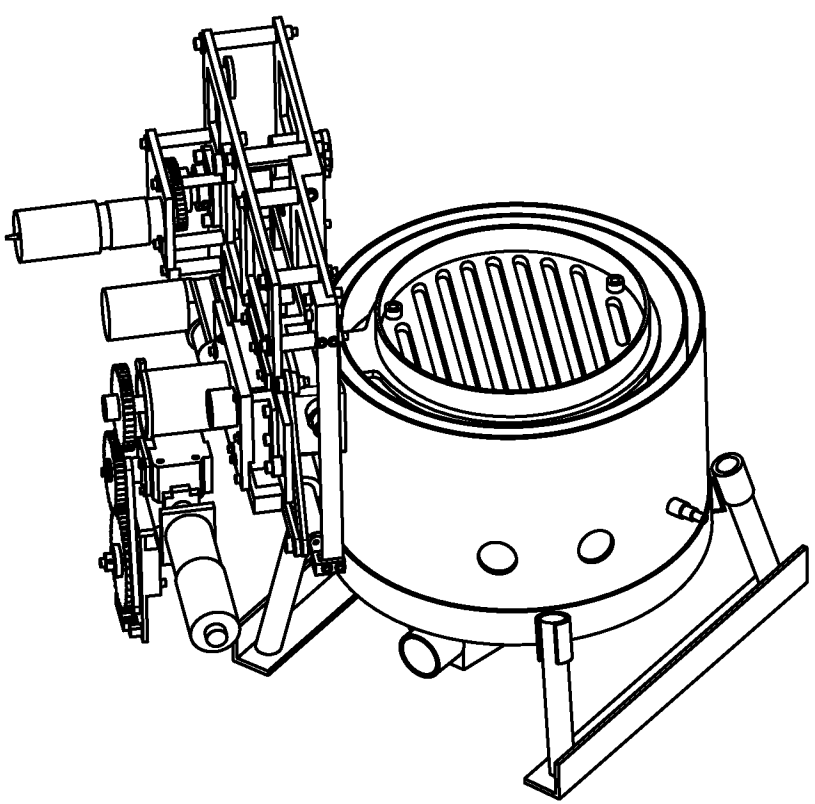
FIGS. 8*a* and 8*b* are perspective views showing, respectively, completely open and completely closed grate positions achievable by servo control in the grate assembly.
Figure 8A:
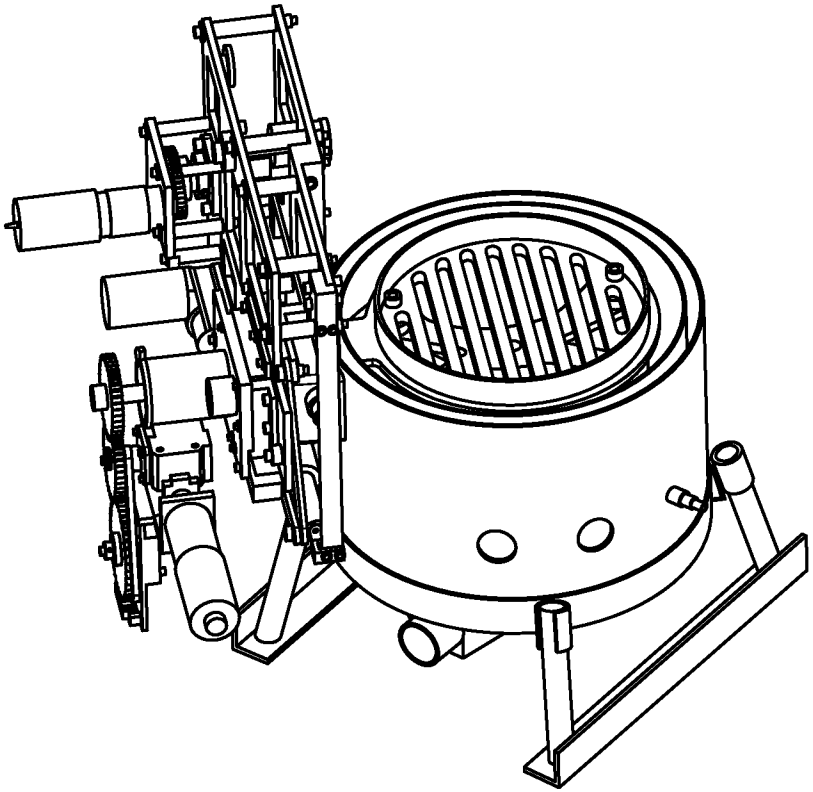

FIGS. 8*a* and 8*b* are perspective views showing grate positions achievable by servo control in the grate assembly. In particular, FIG. 8*a* and FIG. 8*b* show the full range of relative motion of the grate assembly, wherein FIG. 8*a* depicts a fully open grate assembly 800 which allows larger particle exit, while FIG. 8*b* depicts a minimally open grate assembly 810 which preferentially admits fine particles.

Figure 9:
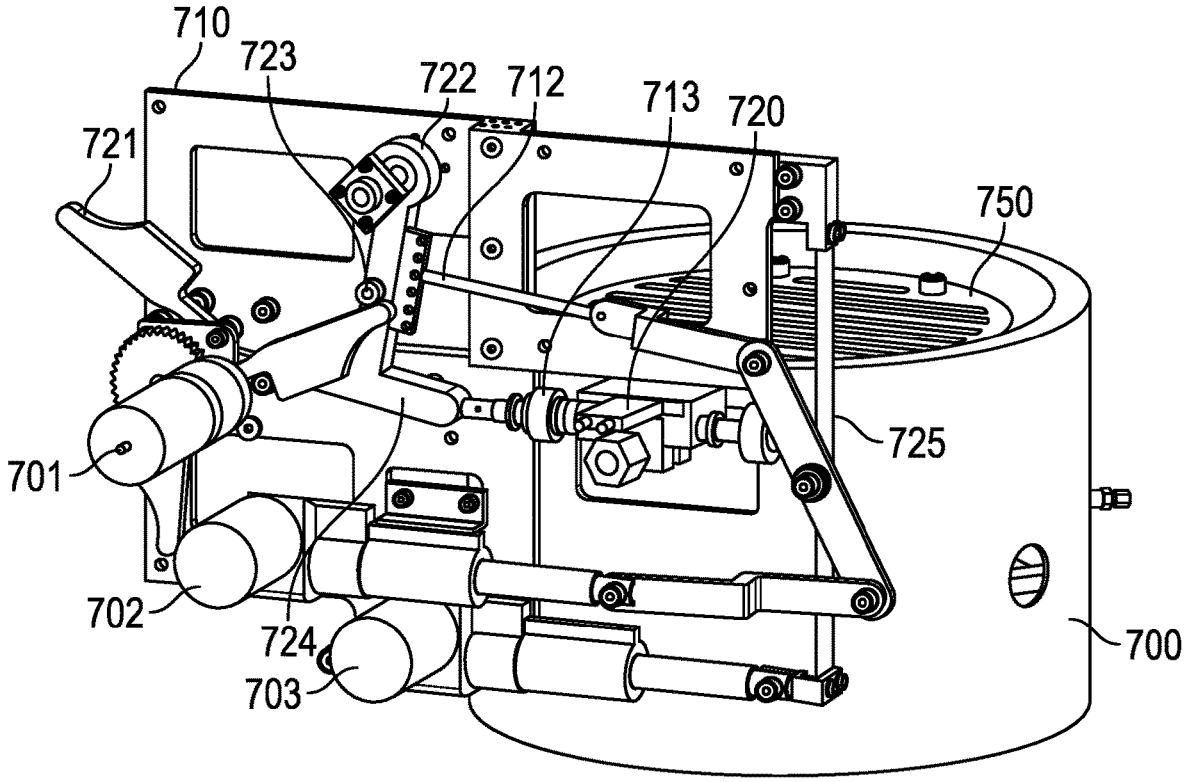
FIG. 9 is a perspective view depicting a device that implements shock-induced displacement in a gasifier.
Figure 10B:
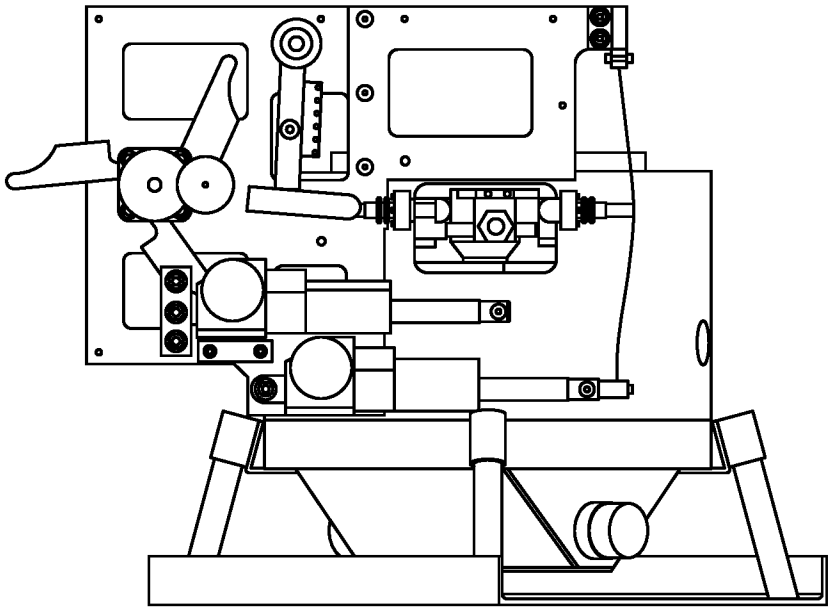
FIGS. 10*a* and 10*b* are plan views showing the different positions of a tensioner belt in a shock-induced displacement device.
Figure 10A:
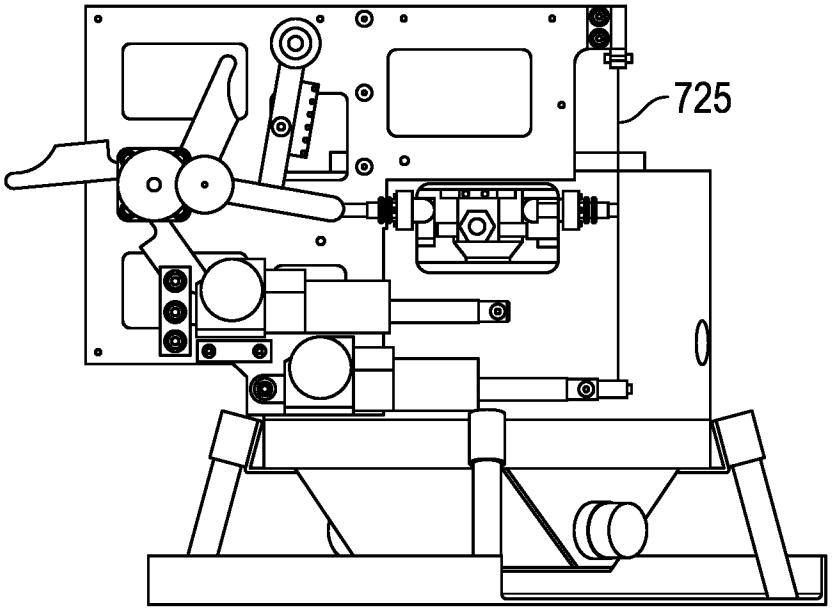
Figure 10D:
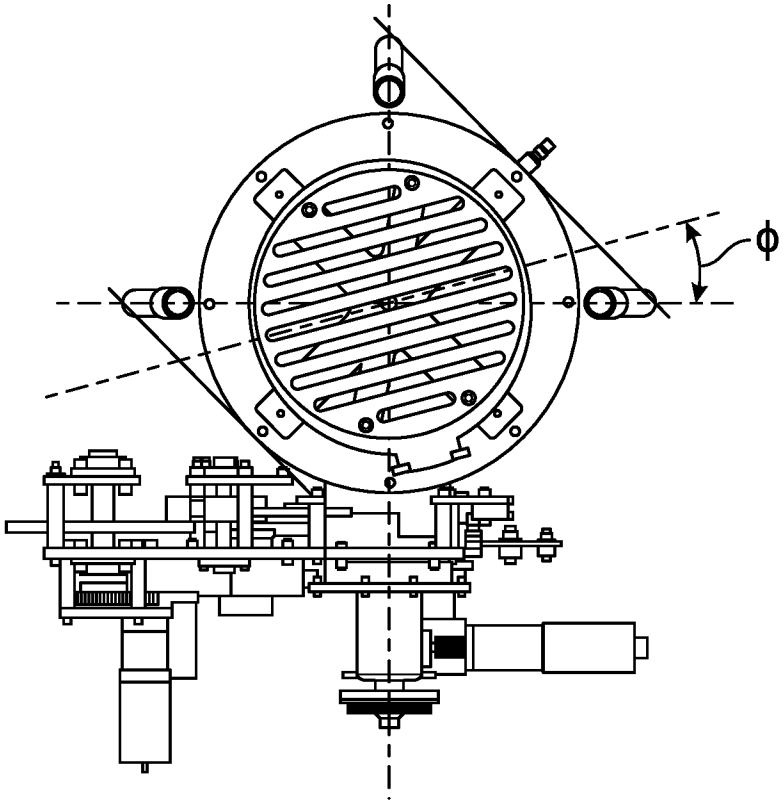
FIG. 10*c* and FIG. 10*d* are corresponding top views, indicating rotation of grate by angle $\phi$ about a center axis.
Figure 10C:
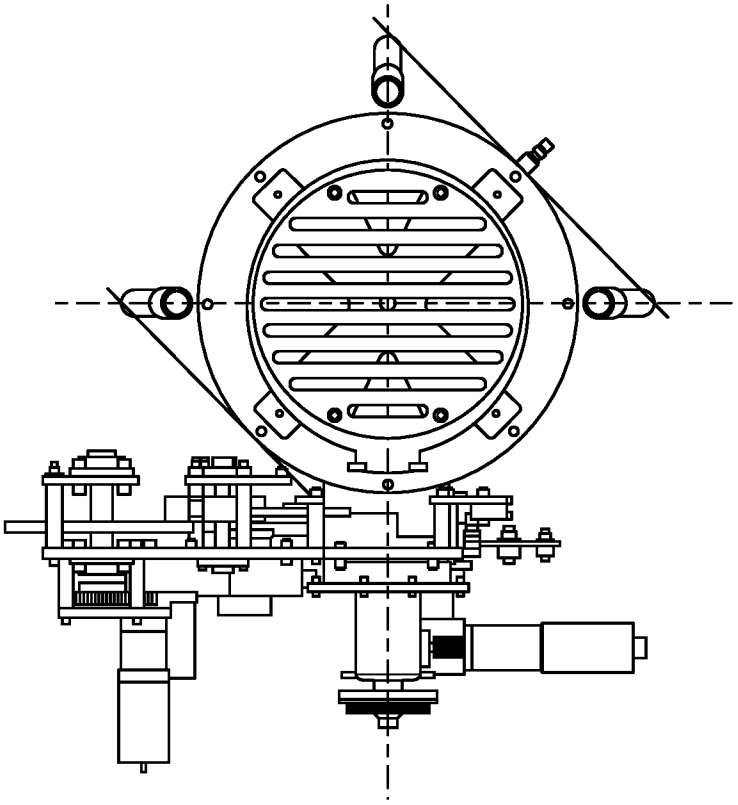

The shock-prompted agitation method 45 is another method to break bridging that relies on hammer-like impacts to dislodge particles. An implementation of this method is illustrated in FIG. 9, which shows an embodiment using a cam driven grate assembly. With reference to FIG. 9, cam 721 is driven by motor 701 and contacts cam follower 723 located on weight arm 722. As the cam rotates it lifts the follower and weight arm against resistance provided by spring 712 whose resistance is regulated by motor 702. As the cam rotates, the cam clears the follower and extension arm 724 impacts the plunger 713 which in turn imparts energy to the protruding arm 720 of rotatable grate 750. On the opposing side of the protruding arm is another plunger which experiences a belt tension supplied by belt 725 and regulated by motor 703. An illustration of the assembly range of motions is shown in FIGS. 10*a*, 10*b*, 10*c* and 10*d*. FIG. 10*a* shows a belt in a relaxed position with the grate in an un-rotated state. In FIG. 10*b*, arm extension 722 has impacted the plunger, causing the grate to rotate about its principal axis and the opposing plunger to exert a force on belt 725, as shown by deflection of the belt. Corresponding top views are shown in FIG. 10*c* and FIG. 10*d*, with FIG. 10*d* indicating a grate rotation by angle $\phi$ about the center gasifier axis, compared to FIG. 10*c*, which shows no rotation.

An additional method which can be used in conjunction with the present disclosure is vibrational excitation of gasifier walls. This method is implemented, as shown in FIG. 3, via device 230 which comprises a small weight attached to a motor, in which the weight rotates off axis the principal motor rotation. This additional feature is useful for removing bridging caused by very fine particles.

Figure 11B:
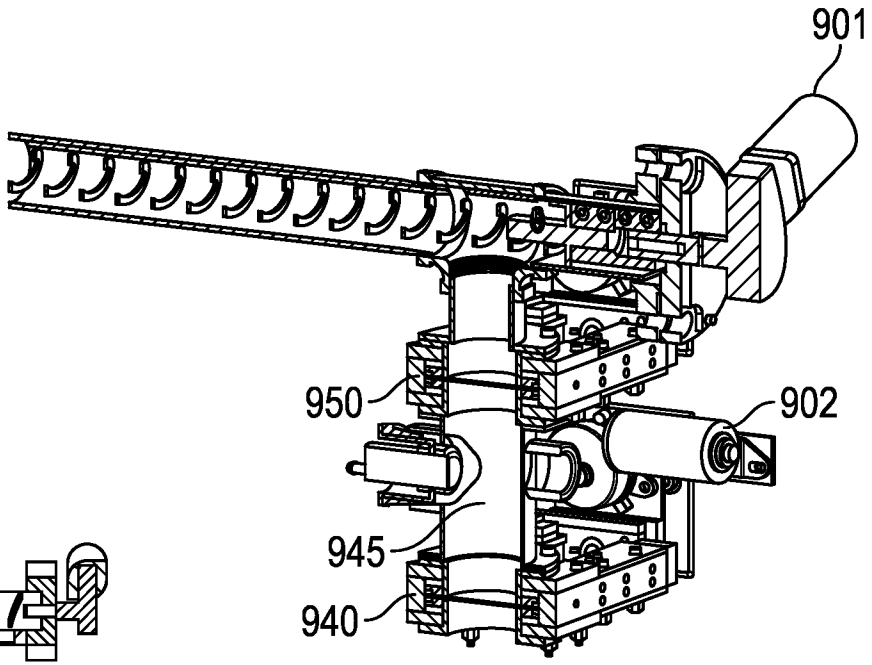
FIGS. 11*a* and 11*b* are cross-sectional views illustrating the exit auger along with gate valves that control air inflow to the gasifier and prevent accidental oxidation of char.
Figure 11A:
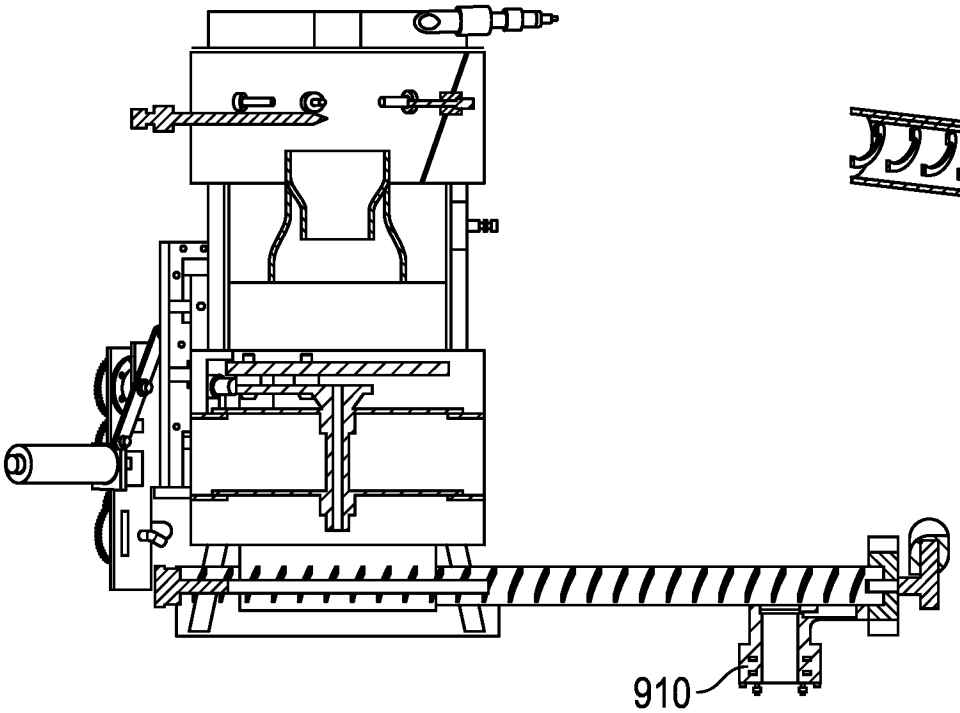

Material exiting the grate assembly drops onto exit auger assembly 260 which conveys the char or ash particles out of the gasifier. Generally, as shown in FIG. 11*a*, a gate valve 910 is used to exclude oxygen at this stage. If char is produced, it is desirable to include two gates valves, such as valves 940 and 950, as shown in FIG. 11*b*, whereby a compartment 945 between the two gate valves serves as a holding container and insulates the gasifier from oxygen exposure.

Figure 12:
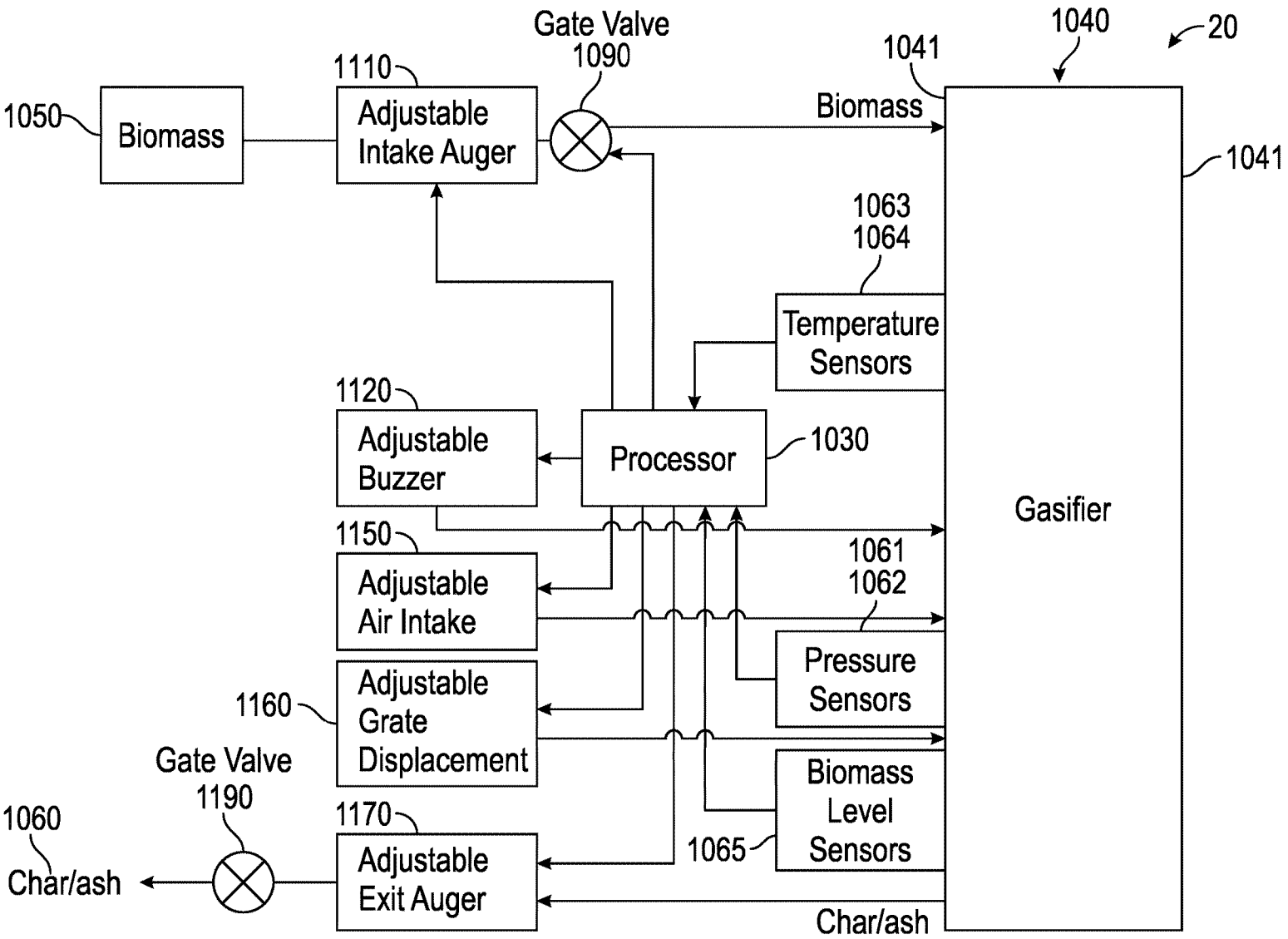
FIG. 12 is an illustration of another embodiment of the various methods used for preventing biomass and charcoal bridging, as set forth herein.
Figure 13:
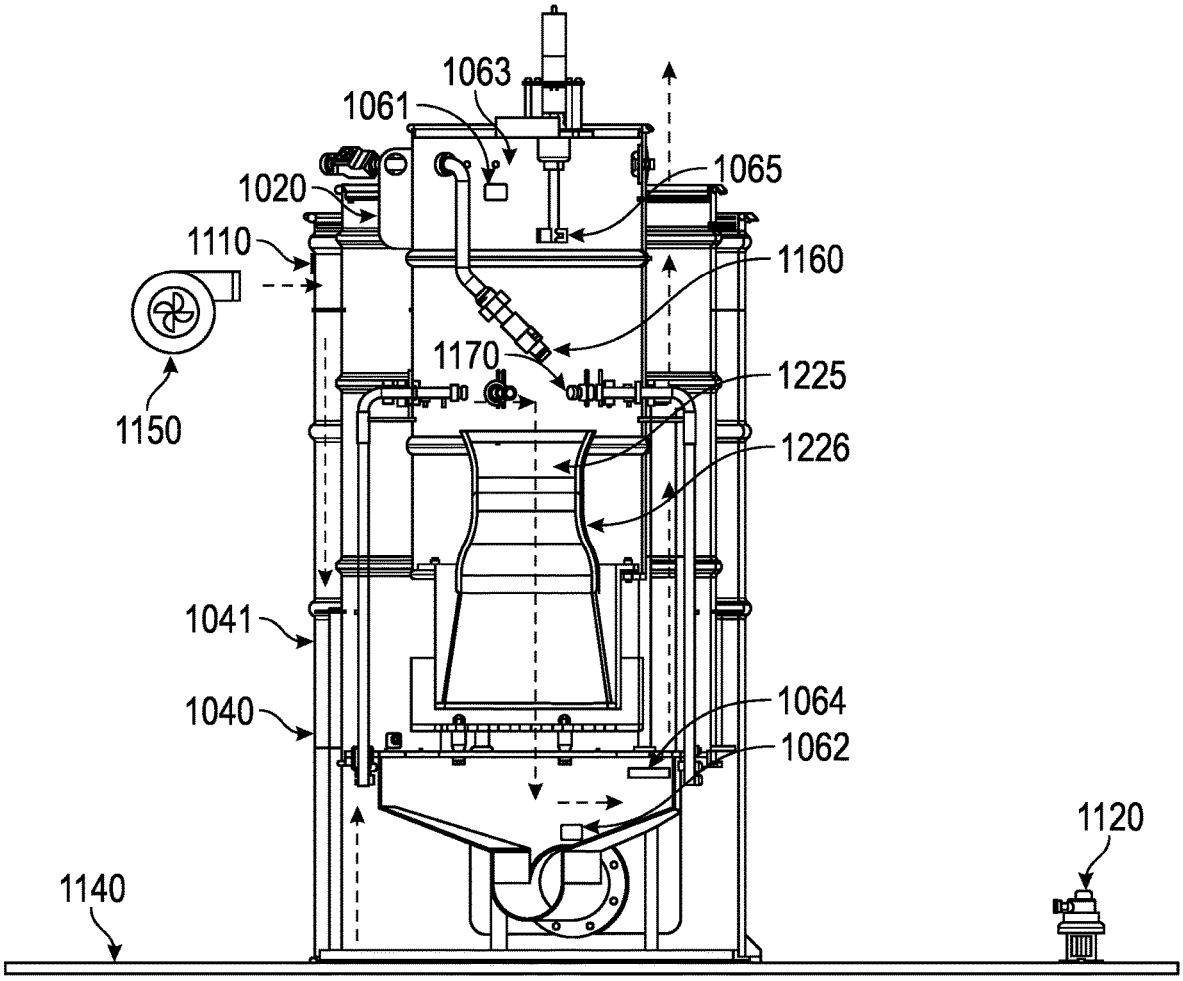
FIG. 13 is an illustration of a system connected according to the embodiment in FIG. 12.

Another embodiment illustrating these principles is shown in FIG. 12 and FIG. 13. Gasifier 1040 has upright cylindrical walls 1041 defining a biomass gasification chamber within. Gasifier 1040 is physically attached to support beam(s) 1140 and this beam is also physically attached to agitation device 1120. Biomass is introduced from the top of the gasifier via load lock mechanism as previously described. The incoming biomass is combusted with the aid of igniter 1160 using air jets 1170 and allowed to fall by gravity into reduction zone 1225 bounded by walls 1226. The interior of gasifier 1040 contains pressure sensors 1061, temperature sensor 1063, and level sensor 1065, all located below the entrance port of the gasifier. Pressure sensor 1062 and temperature sensor 1064 are located below the reduction zone or at the entrance to the exit auger. Adjustable air intake is achieved via one or more variable air blowers, which meter the flow of air through opening 1110 in gasifier. The air flow through the gasifier is shown via dotted arrows in FIG. 13, going down first through an opening running along the wall of the gasifier, then ascending to tubes comprising the air jets, exiting through the air jets and down the reduction zone, and ultimately exiting through the top of the gasifier.

Data from the pressure sensors is fed to processor 1030 which can send signals to activate adjustable agitation device 1120 and/or activate the adjustable intake auger 1110. The agitation device has typically a duty cycle of 2-3 seconds on, and ½ min to 1 min in the off position. Typically a pressure differential preferentially less than 30-40 inches of water between pressure sensors 1061 and 1062 indicates a proper biomass and biochar flow rate without jamming. If the pressure differential is more than these values, the processor sends a signal to vibrate the agitation device until the pressure differential returns to normal range.

Figure 14A:
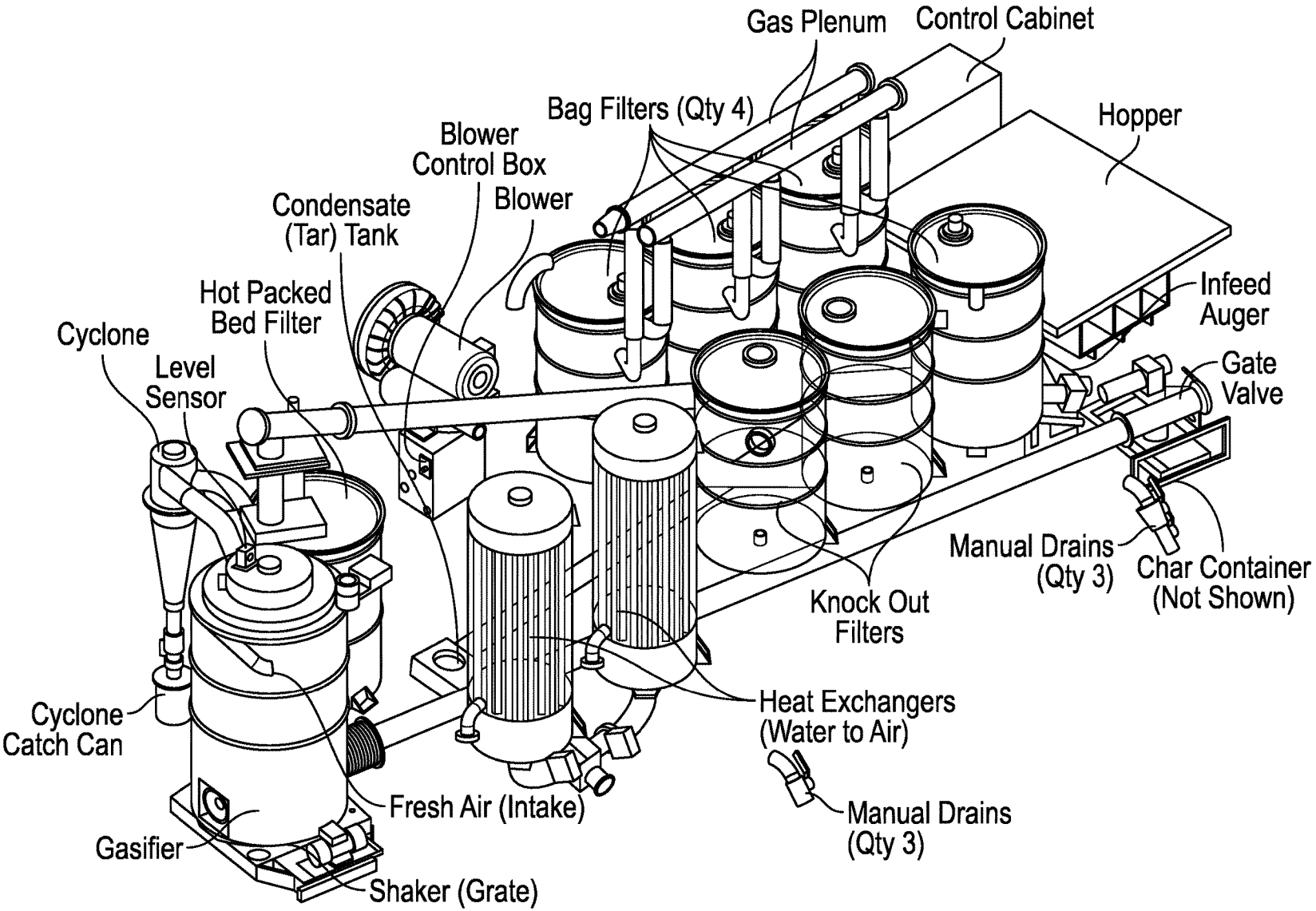
FIGS. 14*a* and 14*b* illustrate an embodiment of a system that uses a negative pressure differential within the system.
Figure 14B:
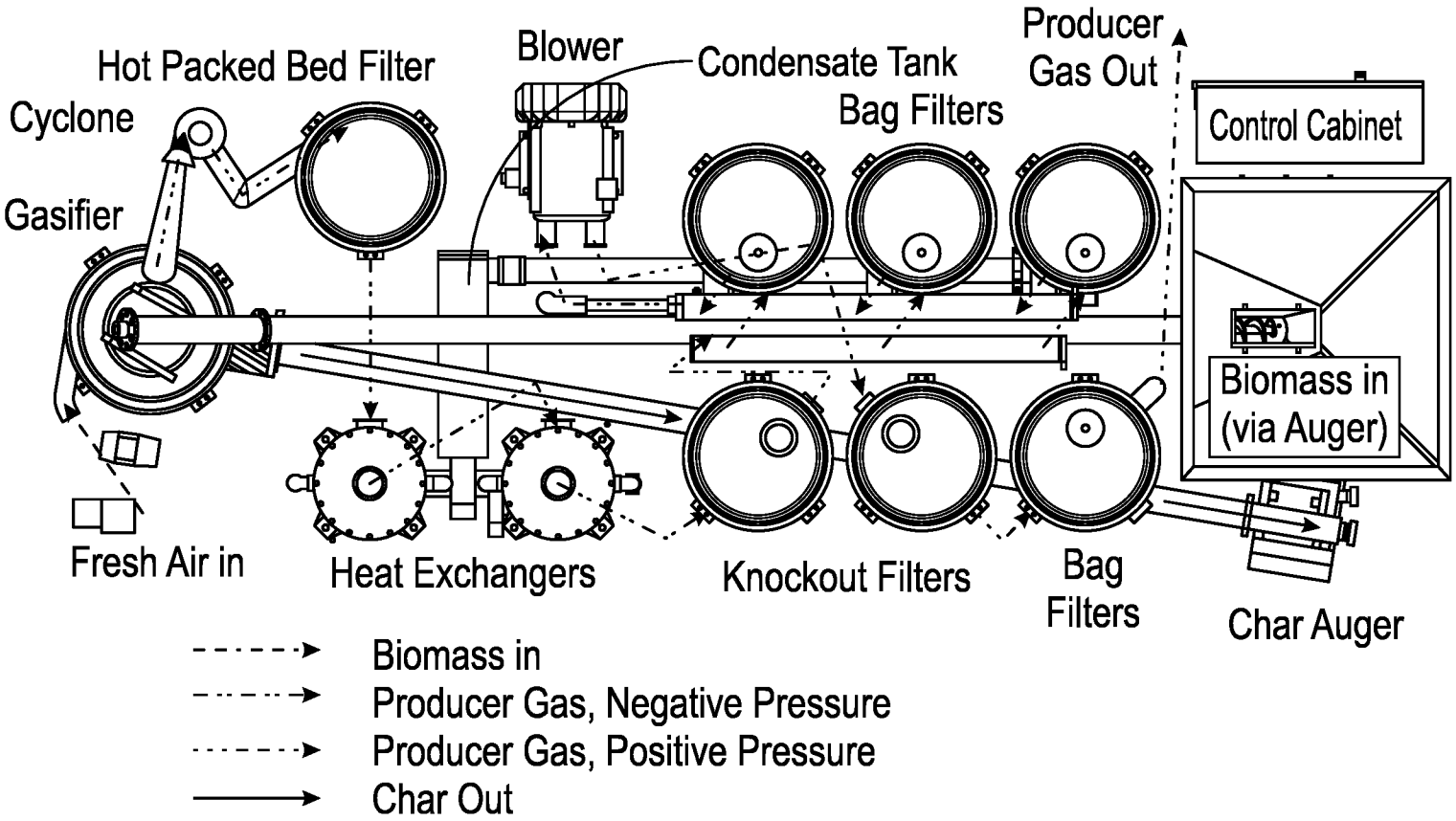

This pressure differential within the system may be maintained with either positive or negative pressure on the gasifier system. An embodiment of a negative pressure system 1400 is shown in FIGS. 14A and 14B. As illustrated, negative pressure is achieved downstream of the gasifier assembly which comprises the gasifier 1405, a variable air blower 1410, hot packed bed filter 1415, knock out filters 1430, heat exchangers 1440 (water to air) and bag filters 1450. In this configuration, a blockage in the gasifier will automatically trigger an anti-jamming action. The air blower 1410 provides the impetus to create a negative pressure within the gasifier 1405, and positive pressure on the exhaust side of the blower 1410. Temperature signals also feed the processor and can regulate the flow of biomass/biochar through the system. Similarly similar signals from the pressure sensors can be sent to the processor to make a decision regarding the degree of displacement of the grate 1160.

Figure 15:
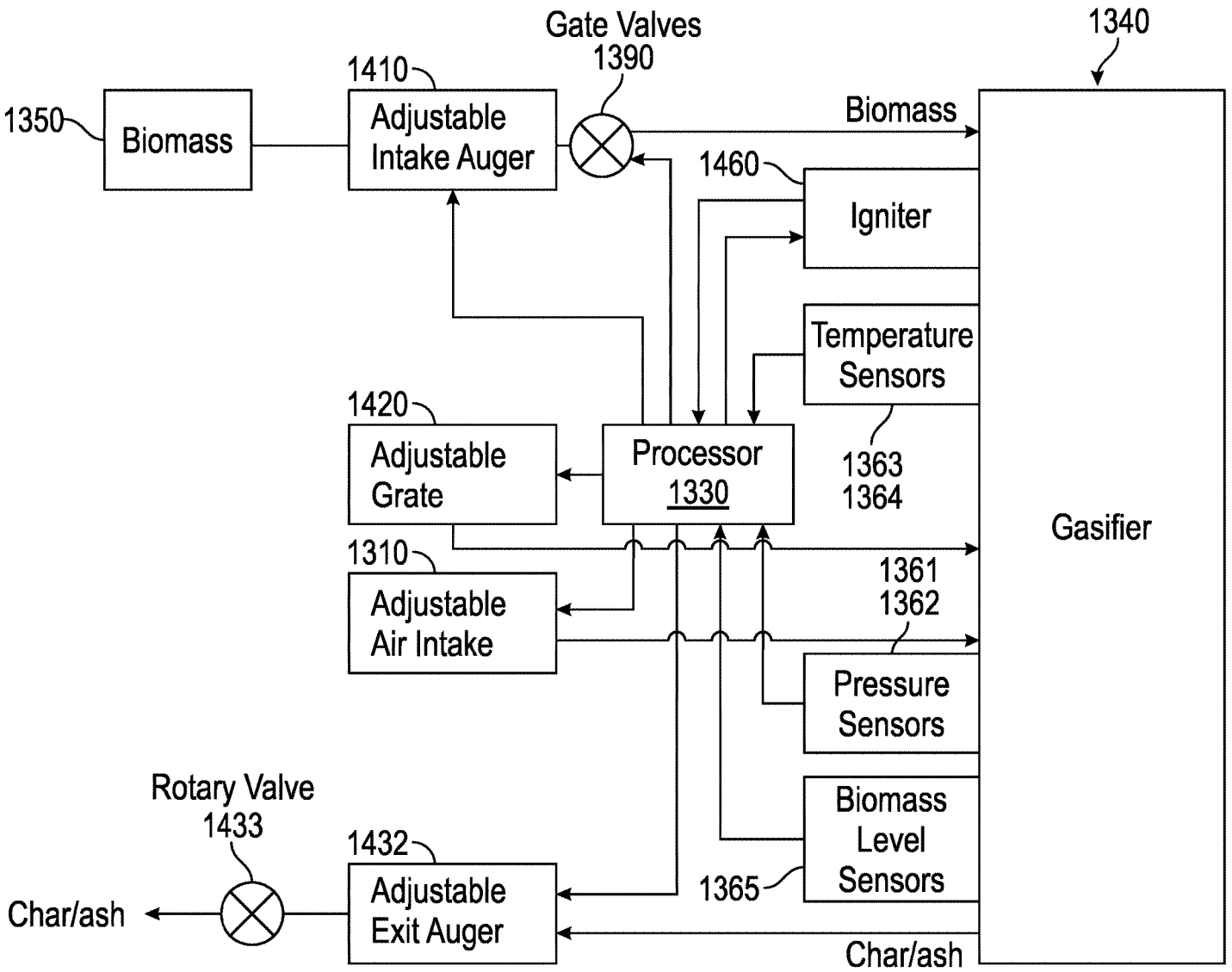
FIG. 15 depicts another embodiment of the various methods used for preventing biomass and charcoal bridging, as set forth herein.
Figure 16:
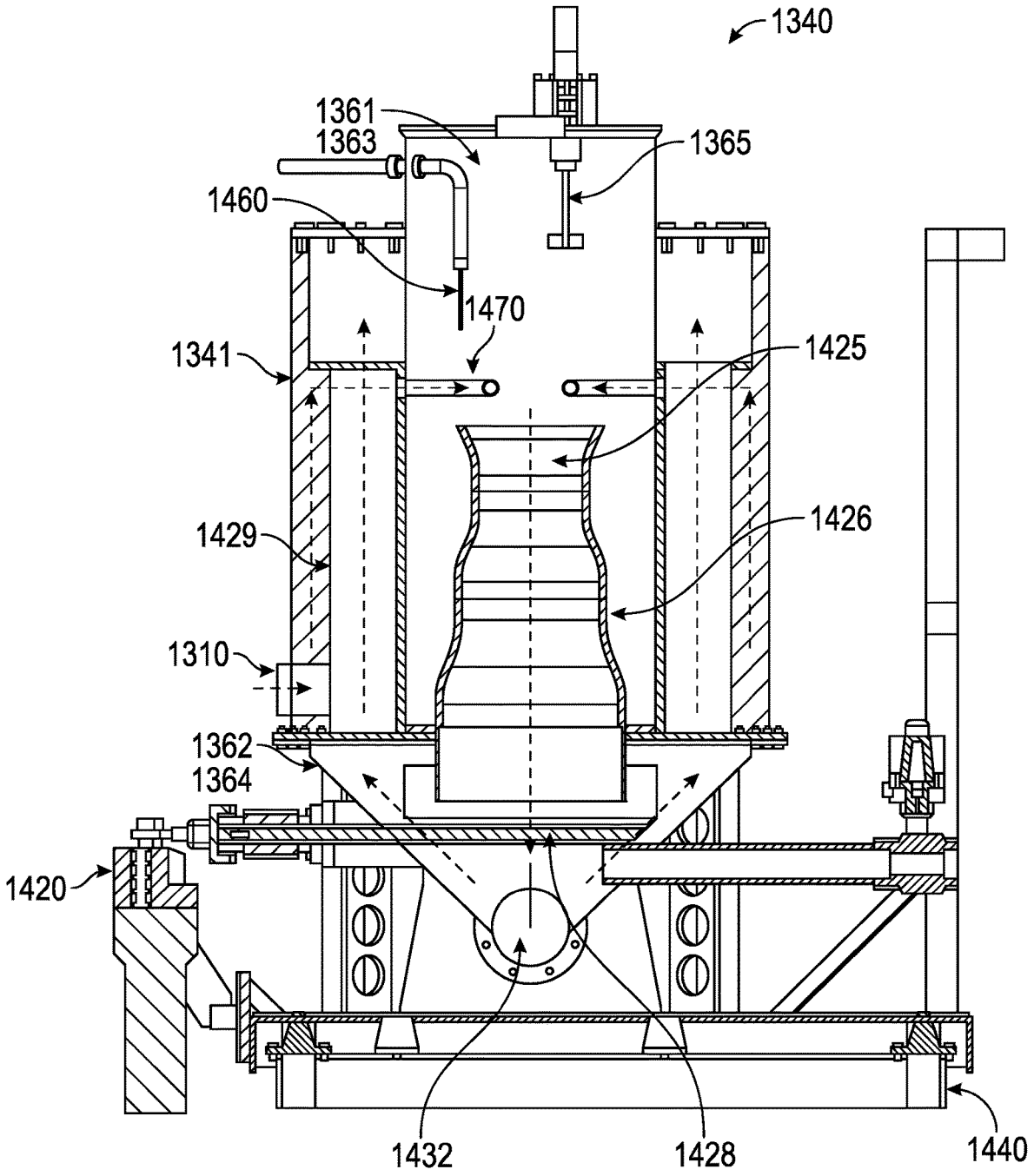
FIG. 16 is an illustration of a system connected according to the embodiment in FIG. 15.

Yet another embodiment illustarting these principles is shown in FIG. 15 and FIG. 16. In particular, gasifier 1340 has upright cylindrical walls 1341 defining a biomass gasification chamber within. Gasifier 1340 is physically attached to support beam(s) 1440 through vibration isolators. Biomass 1350 is introduced from the top of the gasifier via load lock mechanism 1390 as previously described. The incoming biomass is combusted with the aid of igniter 1460 using air jets 1470 and allowed to fall by gravity into reduction zone 1425 bounded by walls 1426. The interior of gasifier 1340 contains pressure sensor 1361, temperature sensor 1363, and level sensor 1365, all located below the entrance port of the gasifier. Pressure sensor 1362 is located at the char exit auger and temperature sensor 1364 is located below the reduction zone. Adjustable air intake is achieved via one or more variable air blowers, which meter the flow of air through tangential opening 1310 in gasifier. The air flow through the gasifier is shown via dotted arrows in FIG. 16, going first through a tangential opening 1310 in the wall of the gasifier, then ascending to tubes comprising the air jets 1470, exiting through the air jets and down the reduction zone 1425, passing through or around the grate 1428, rising through the energy recovery tubes 1429, and ultimately exiting through the top of the gasifier. The flow of biomass and char through the system is controlled by the adjustable grate shaker 1420 and grate 1428, adjustable in displacement and/or velosity, and/or on/off times (duty cycle). The char passes through the grate to the adjustable exit auger 1432.

Data from the pressure sensors is fed to processor 1330, which can send signals to activate either adjustable grate shaker 1420 and/or activate the adjustable intake auger 1410 and/or activate the adjustable air intake 1310. The agitation device typically has a duty cycle of 2-3 seconds on, and ½ min to 1 min in the off position. Typically a pressure differential preferentially less than 30-40 inches of water between pressure sensors 1361 and 1362 indicates a proper biomass and biochar flow rate without jamming. If the pressure differential is more than these values, the processor sends a signal to vibrate the agitation device until the pressure differential returns to normal range.

Figure 17A:
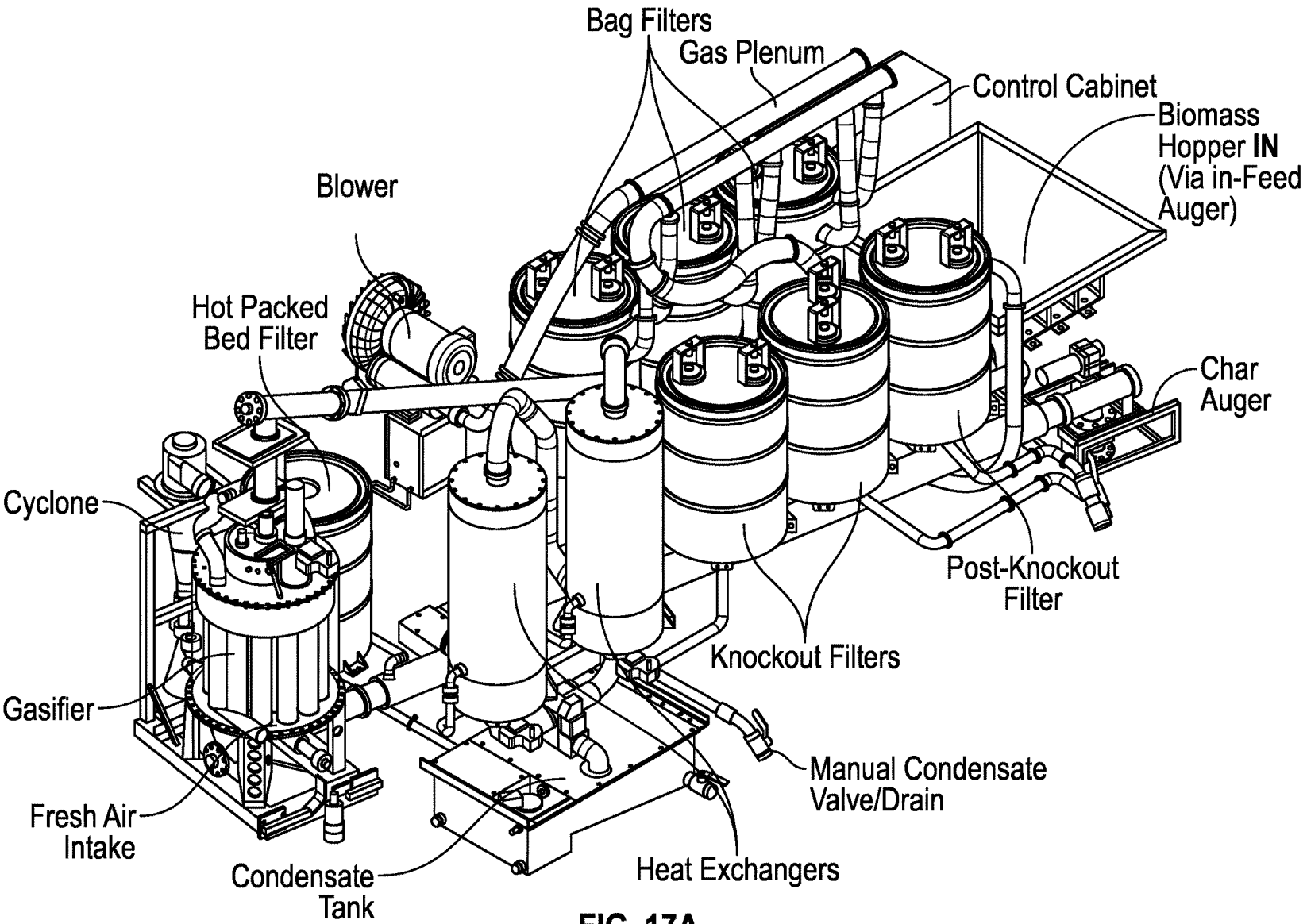
FIGS. 17*a* and 17*b* illustrate an embodiment of a system according to the embodiment in FIG. 15 that uses a negative pressure differential within the system The figures are not intended to be exhaustive or to limit the disclosure to the precise form disclosed. It should be understood that the disclosure can be practiced with modification and alteration, and that the disclosure be limited only by the claims and the equivalents thereof.
Figure 17B:
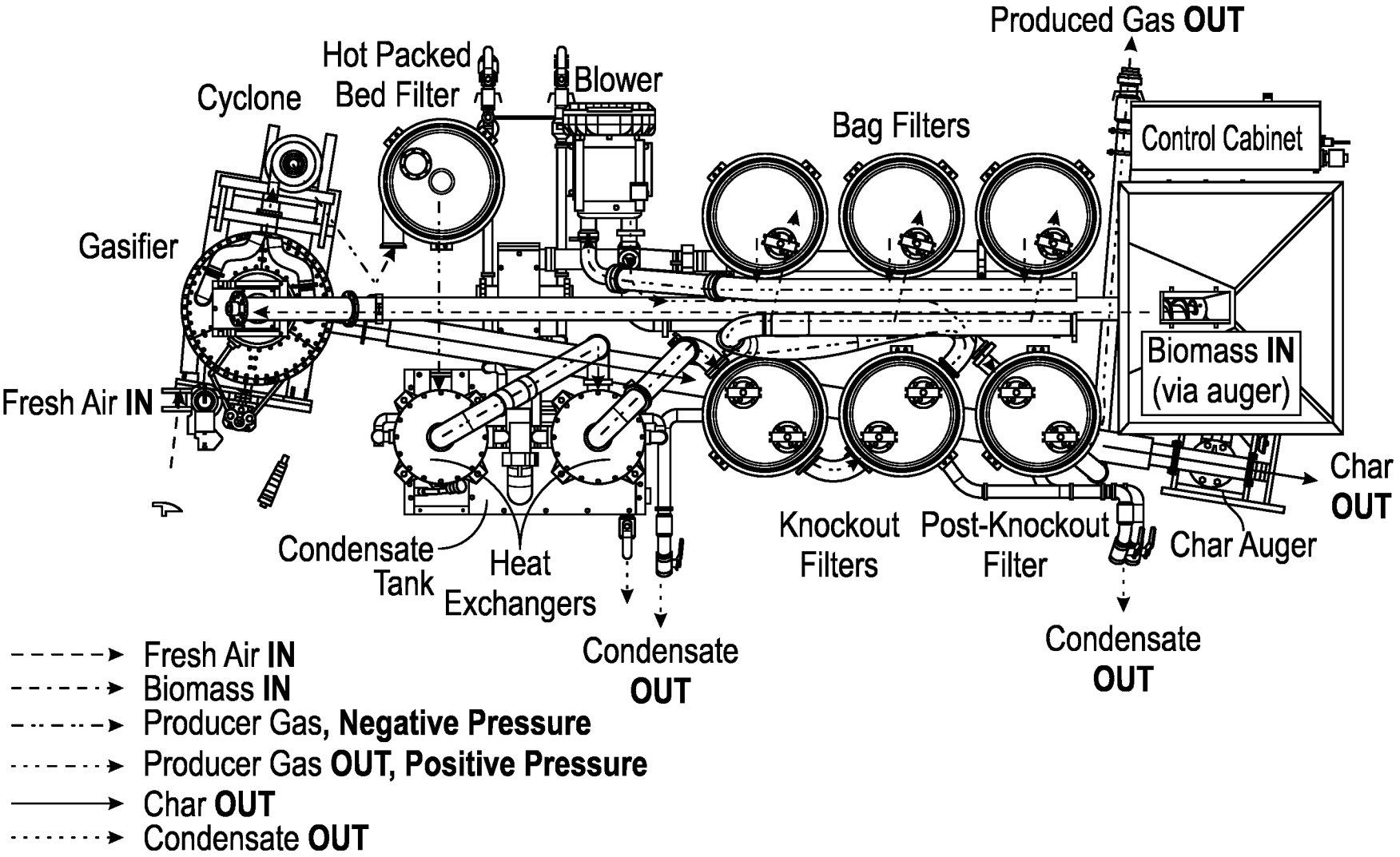

This pressure differential within the system may be maintained with either positive or negative pressure on the gasifier system. An embodiment of a negative pressure system 1700 is shown in FIGS. 17A and 17B, which depict system side and top view, respectively. As seen in the figures, negative pressure is achieved downstream of the gasifier assembly which comprises the gasifier 1705, hot packed bed filter 1710, heat exchangers 1720, knockout filters 1730, bag filters 1740, and a variable air blower 1750. In this configuration, a blockage in the gasifier 1705 will automatically trigger an anti-jamming action. The air blower 1750 provides the impetus to create a negative pressure within the gasifier 1705, and positive pressure on the exhaust side of the blower 1750. Temperature signals also feed the processor and can regulate the flow of biomass/biochar through the system. Similarly similar signals from the pressure sensors can be sent to the processor to make a decision regarding the velosity and duty cycle of the grate 1460.

The present disclosure allows fast start-up with consequent hydrogen production.

One skilled in the art will appreciate that the present disclosure can be practiced by other than the various embodiments and preferred embodiments, which are presented in this description for purposes of illustration and not of limitation, and the present disclosure is limited only by the claims that follow. It is noted that equivalents for the particular embodiments discussed in this description may practice the disclosure as well.

While various embodiments of the present disclosure have been described above, it should be understood that they have been presented by way of example only, and not of limitation. Likewise, the various diagrams may depict an example architectural or other configuration for the disclosure, which is done to aid in understanding the features and functionality that may be included in the disclosure. The disclosure is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the present disclosure. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosure is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the disclosure, whether or not such embodiments are described and whether or not such features are presented as being a part of a described embodiment. Thus the breadth and scope of the present disclosure should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration.

The invention claimed is:

1. A system for automatic solids flow for the gasification of biomass, comprising:

a gasifier comprising a gasification chamber having an upper section, a reduction zone disposed below the upper section, and a lower section disposed below the reduction zone;

a biomass intake device for metering biomass fuel into said upper section;

an air intake device connected to said upper section, whereby synthesis gas and biochar are generated upon gasification of said biomass fuel and air in the reduction zone;

a grate assembly device comprising a grate within the lower section and an adjustable grate shaker configured to control the flow of biochar out of the gasifier;

a loadlock connected to the lower section having two gates valves, a compartment between the two gate valves serving as a holding container and insulating the gasifier from oxygen exposure, and an outlet;

temperature, pressure and biomass level sensors configured to detect the amount and status of biomass within the gasification chamber;

a processor system configured to take input from at least one sensor and activate one or more of said devices; and a variable air blower located downstream of the gasifier and configured to meter the flow of air through the air intake system and the loadlock to create a negative pressure within the gasification chamber and positive pressure on an exhaust side of the loadlock outlet;

wherein the processor system is programmed to activate the grate shaker when a pressure differential between the positive and negative pressures is more than 40 inches of water.

2. The system of claim 1, wherein the pressure sensor or sensors is configured to control the grate shaker duty cycle.

3. The system of claim 1, wherein the grate shaker has a duty cycle of 2-3 seconds on, and ½ min to 1 min off.

4. The system of claim 1, wherein the pressure sensor or sensors is configured to activate the device for metering biomass into said gasification chamber.

5. The system of claim 1, wherein the temperature sensor is configured to activate the metering device.

6. The system of claim 1, wherein the temperature sensor is configured to activate the air intake device.

7. The system of claim 1, wherein the biomass level sensor is configured to activate the air intake device.

* * * * *